United States Patent [19]

Kolev et al.

[11] 3,933,496

[45] Jan. 20, 1976

[54] DIRECT-POSITIVE PHOTOGRAPHIC MATERIAL AND METHOD FOR ITS PRODUCTION

[75] Inventors: Konstantin Nikolaev Kolev; Jordan Petrov Malinowski, both of Sofia, Bulgaria

[73] Assignee: Zlafop pri Ban, Bulgaria

[22] Filed: Nov. 15, 1973

[21] Appl. No.: 416,009

[30] Foreign Application Priority Data

Nov. 15, 1972 Bulgaria ..... 21873

[52] U.S. Cl. ..... 96/48 R; 96/48 PD; 96/48 QP; 96/60 R; 427/248; 427/253; 96/67

[51] Int. Cl.[2] ..... G03C 5/24

[58] Field of Search ..... 96/48 PD, 67, 60 R; 117/212, 130 E

[56] References Cited

UNITED STATES PATENTS

| | | | |
|---|---|---|---|
| 3,562,005 | 2/1971 | De Angelo et al. | 96/48 PD |
| 3,637,378 | 1/1972 | Hallman et al. | 96/88 |
| 3,637,383 | 1/1972 | Hallman et al. | 96/88 |
| 3,762,325 | 10/1973 | Hallman et al. | 96/88 |

FOREIGN PATENTS OR APPLICATIONS

| | | | |
|---|---|---|---|
| 1,151,310 | 5/1969 | United Kingdom | 96/48 PD |

*Primary Examiner*—David Klein
*Assistant Examiner*—Judson R. Hightower
*Attorney, Agent, or Firm*—Armstrong, Nikaido & Wegner

[57] ABSTRACT

This invention relates to a photographic material yielding upon exposure a direct-positive image and to a process for the production of such material.

6 Claims, No Drawings

DIRECT-POSITIVE PHOTOGRAPHIC MATERIAL AND METHOD FOR ITS PRODUCTION

Many experiments have been made for the development of new photographic materials, particularly non-silver materials. However, only a small number of these photographic materials are of the direct-positive type, and almost all of them are based on organic compounds. The Bulgarian Pat. No. 12078, corresponding to the British Pat. Specification No. 1,151,310 from 1969, and the Bulgarian Pat. No. 17,681, corresponding to the Belgian Pat. No. 785,508, disclose direct-positive photographic materials using only inorganic light-sensitive substances. These photographic materials comprise a carrier base onto which is deposited a thin layer of metal nuclei, onto which a second thin layer of suitable light-sensitive substance is deposited. Under the influence of the activating light, the light-sensitive substance reacts chemically with the metal nuclei in the exposed areas, thus destroying the metal nuclei, while in the non-exposed areas they remain unchanged. After exposure, the unreacted light-sensitive substance is removed by means of appropriate solvents. The metal nuclei remaining on the non-lighted areas of the photographic material are capable of catalysing the selective deposition of another metal by means of conventional physical development or chemical metallization and so the obtained image can be intensified.

It is known that chemical metallization, particularly in copper, nickel, cobalt, iron and other baths, is efficiently catalized by nuclei of palladium, platinium, gold. However, since the latter are noble metals and cannot readily react with the products of the photodecomposition of the light-sensitive compounds used. This hinders the use of these noble metals in the photographic materials, produced according to the aforementioned Patent Specifications. Thus, this limits the use of the most commonly used baths for chemical metallization in the selective deposition of metals.

On the other hand, it is known for a long time that chemical deposition of metals in copper, nickel, cobalt, iron and other baths onto non-metallic inert substrates can be well activated by divalent salts of tin and lead and trivalent salts of titanium. This is attributed to the easy palladium-, platinium- or gold-plating of the metal ions of these salts.

The experiments carried out according to the present invention showed surprisingly that the chemical activity of the salts of divalent tin, divalent lead and trivalent titanium, when in intimate contact with suitable light-sensitive substances, is selectively destroyed on the lighted areas. This provides a possibility for obtaining a new photographic material.

It is therefore an object of the present invention to provide a photographic material, yielding upon exposure a direct-positive image, and this image is developed (intensified) by a process of chemical metallization. This material comprises a non-metallic carrier base onto which thin layers of suitably selected metal salt and light-sensitive substance are deposited in intimate contact. When activated by exposure to light, the light-sensitive substance reacts chemically with the metal salt in such a way, that on the lighted areas the metal ions of the salt lose their catalytic activity towards the metallizing baths, whereas on the non-lighted areas they remain unchanged, forming thus a direct positive image which is additionally stabilized and intensified.

A further object of the present invention is to provide a method for the production of direct-positive photographic material, which comprises depositing onto a non-metallic carrier base of ultra-thin layers of a suitably selected metal salt and a light-sensitive substance which upon exposure to light reacts chemically with the metal salt in a manner such that on the lighted areas the metal ions of the salt lose their catalytic activity, while on the non-lighted areas they remain unchanged.

The photographic material according to the present invention comprises a carrier base, onto which in intimate contact are deposited thin layers of a metal salt containing the ions $Sn^{2+}$, $Pb^{2+}$, $Ti^{3+}$, and a suitable light-sensitive substance. Under the influence of the activating light the light-sensitive substance reacts chemically with the aforementioned metal salt in the lighted areas, and as a result the metal ions of the salt lose their catalytic activity, while in the non-lighted areas they remain unchanged, thereby building up a direct-positive latent image. If necessary, after exposure the light-sensitive substance is removed by means of suitable solvents. The invisible (latent) image obtained can be intensified and visualized by means of chemical metallization or physical development after preliminary activation in a solution of the salt of a noble metal.

The thin layer of a salt of divalent tin, divalent lead or trivalent titanium is deposited by vacuum evaporation or by dipping in a solution of the salt. The photographic sensitivity of the material is determined by the quantity of the deposited metal salt. This sensitivity increases with the decrease of the quantity of the salt; it is obvious that the quantity of salt can never be lower than the minimum amount required for catalytic deposition of the metal from the corresponding bath for metallization. This quantity can be easily determined empirically and the experiments show that for the most commonly used baths it is about $10^{-6}$g/cm$^2$.

The deposition of a salt of a light-sensitive substance is carried out by evaporation in vacuum, cathode sputtering in an inert atmosphere, spraying, coating or dipping. Usually, the sensitivity of the material increases with the increase of the thickness of the layer of the light-sensitive substance. The optimum thickness depends on the type and the quantity of the metal salt used, as well as on the type of the light-sensitive substance used. Usually, the sensitivity reaches saturation at $10^{-3}$ to $10^{-5}$g/cm$^2$ of the light-sensitive substance. Suitable photosensitive compounds are the halides of silver, cadmium, lead, bismuth, thallium, zinc, copper and mercury, as well as the Chalcogenides or oxides of arsenic, lead, cadmium, and antimony.

The type (nature) of the combination "metal salt - photosensitive substance" determines the succession in depositing the thin layers onto the carrier base. If the layer of light-sensitive substance is deposited immediately onto the carrier base, a necessary condition for retaining of the image at development is the layer to be insoluble in the treating solutions. When the layer of light-sensitive substance is deposited onto the layer of metal salt so as to isolate the latter from the atmosphere, the stability of the photographic material during storage is substantially increased.

On exposure, under the influence of the activating light a photochemical reaction takes place at the lighted areas. The photoactivated light-sensitive substance or the photoactivated products of the light-sensitive substance react with the metal salt in such a way, that the metal ions of the salt lose their catalytic activity towards the metallizing baths.

In cases when the layer of light-sensitive substance is deposited onto the layer of metal salt, it is necessary, before development, to remove it by means of suitable solvents. This leads also to stabilizing of the image against further light action.

The image is efficiently intensified and visualized by means of conventional chemical metallization or physical development with a preliminary activation in a solution of a salt of a noble metal. Depending on the metallizing bath chosen, the image can be built up by a number of metals, such as copper, nickel, chromium, cobalt, iron, silver, tin, as well as by a combination of metals. This makes the photographic material suitable for some special applications in engineering and electronics, which require a selective deposition of different metals or combinations of metals, which feature superconductive or magnetic properties. On the other hand, chemical metallization as a means for visualizing the latent image, makes it possible to obtain a very contrast image at prolonged development. As a result the photographic material can be used in the field of photodocumentation, in microelectronics for preparing targets and masks, for drawing purposes, in photolithography, etc. The simple chemical treatment, resulting from the easy solubility of most of the compounds used, as well as the possibility of galvanic thickening of the metal image, make the photographic material especially suitable for use in electronics in preparing printed circuits on different substrates, including flexible ones.

Different types of non-metallic carrier bases can be used in the production of the photographic material according to the present invention, such as polyester film — for example of the "Melinex S" type (a product of the Imperial Chemical Industries Ltd., Great Britain), which, in order to improve the fixing of the metal image, can be coated with "Novoprint" adhesive resin (a product of the West German Company Schering A.G.), with the "Tite-Bond" adhesive (a product of Croda Polymers Ltd., Great Britain), the 200-TF Adhesive (a product of Shipley Europe Ltd., Great Britain) or the polyester Adhesive 46971 (a product of E. I. Du Pont de Nemours, USA); polyester "Mylar" type film; polyamide film, for example "Capton" (a product of E. I. Du Pont de Nemours, USA); diacetate film — for example "Bexford 123/006" (a product of Bexford Ltd., Great Britain); triacetate film—for example of the 2002003 type (a product of Bexford Ltd., Great Britain); drawing (drafting) film — for example of the M5 -D50 type (a product of Bexford Ltd., Great Britain); fibreglass or standard glass coated with suitable adhesives — for example Novoprint or Tite-Bond as mentioned above; standard cellulose or polyester barite paper used in photographic industry; plexiglas, ceramics, as well as many other non-metallic substrates.

An important requirement to each of these aforementioned substrates is their wettability when the layers are applied from solutions, i.e. the surface to retain a thin liquid layer after dipping in a solution. Since almost all aforementioned substrates are hydrophobic, each one must undergo a previous specific treatment to be hydrophylized.

The invention is illustrated by way of the following examples.

EXAMPLE 1

One of the carrier bases specified above, for example triacetate film 2002003, was hydrophylized by dipping for 2 to 5 minutes at room temperature in a 10% solution of sodium hydroxide and was then abundantly washed in deionized water. Then a thin layer of tin dichloride was applied by dipping for 2 minutes at room temperature in a solution with the following composition:

| | |
|---|---|
| $SnCl_2.2H_2O$ | 20 g |
| K.HCl | 10 ml |
| $H_2O$ dist. | up to 1 l. |

The sample was then washed in deionized water for 2 to 3 minutes and dried in air stream. Immediately after that a layer of light-sensitive substance (for example of cadmium iodide) was applied by evaporation in vacuum. This is carried out in a conventional vacuum installation operating at $5.10^{+5}$ torr. The cadmium iodide was evaporated from a tantalum crucible with aperture of about 7 mm diameter, at a diatance of about 8 cm from the carrier base. The thickness of the evaporated layer was checked with the Film Thickness Monitor (a product of Edwards High Vacuum Ltd., Great Britain). At a temperature of the crucible of about 350°C, controlled by a Pt/Pt-Rh thermocouple, a layer of about $1.10^{-4}$g/cm$^2$ of cadmium iodide was deposited.

The photographic material obtained in this way was exposed for 30 seconds to a collimated beam from a 100 Watt xenon lamp, passed through a transparency, at a distance of 16 cm to the sample. The photoactivated cadmium iodide reacted with the layer of stannous chloride; as a result the metal ions of the stannous salt losed their catalyticactive properties. On the non-lighted areas of the material the stannous salt remained intact. Thus, a latent direct positive image of the transparency was formed.

After removing the layer of cadmium iodide by washing in water at room temperature, the material was dipped for 20 to 30 seconds in a solution of a salt of a noble metal, for example:

| | |
|---|---|
| $PdCl_2$ | 0,26 g |
| K.HCl | 2,5 ml |
| $H_2O$ dist. | up to 1 l. |

The sample was then washed in deionized water for about 1 minute.

The obtained direct positive image was intensified by chemical metallization by dipping at room temperature in a bath with the following composition:

| | |
|---|---|
| $CuSO_4.5H_2O$ | 10 g |
| NaOH | 17 g |
| $K_2CO_3$ | 4 g |
| Segnette salt | 50 g |
| EDTA | 0,7 g |
| $H_2O$ dist. | up to 900 ml. |

Before use, 100 ml of 36–38% formaldehyde was added to the aforementioned solution while stirring it.

The visualization can be achieved also the commercial bath for chemical copper plating "Noviganth G.S." (a product of Schering A.G., West Germany).

EXAMPLE 2

One of the aforementioned carrier bases, for example polyester film "Melinex S" coated with adhesive resin Novoprint was hydrophylized by etching for 1 to 2 minutes at room temperature in a solution with the following composition:

| | |
|---|---|
| $K_2Cr_2O_7$ | 15 g |
| $H_2SO_4$ | 100 ml |
| $H_2O$ dist. | 50 ml. |

After abundant washing of the sample in deionized water, a thin layer of stannous chloride was applied by dipping for 2 minutes at room temperature in a solution with a composition as described in Example 1. The sample was again washed in deionized water and dried in an air stream, after which a layer of cadmium iodide was applied by spraying. This is carried out by spraying for several seconds with a normal glass spraying device a 10% water solution of cadmium iodide from a distance of 50 cm. The duration of spraying is chosen so, that the quantity of deposited dry substance is about $10^{-4}$g/cm$^2$. After drying in air stream for a short time, the photographic material obtained was exposed for 90 seconds to a collimated beam from a 100 Watt xenon lamp, passed through a transparency.

Furter on, following the treatment described in Example 1, a visible copper image of the printed transparency is obtained. If this transrency is of a printed circuit with suitably made connections, the image obtained after chemical metallization can be further thickned by the much faster and cheaper electrolytic deposition of copper. However, the electrolytic plating requires a special design of the printed circuit providing electroconductive interconnections of all metal parts so that they can easily be connected to the cathode. If this is provided, the electrolytic deposition of copper is successfully achieved with eacg commercially available bath, such as for example the "Cupracid 66 (a product of Schering AG, West Germany).

EXAMPLE 3

One of the aforementioned carrier bases, for example fibreglass or normal glass coated with the adhesive resin Novoprint or with the adhesive Tite-Bond was hydrophylized as described in Example 2. Then a thin layer of stannous chloride was applied as described in Example 1 and the sample was dried in air. Immediately after that a layer of cadmium iodide was applied by pouring over. This was carried out by fixing the sample in horizontal position and pouring over the necessary quantity of 5% water solution of cadmium iodide with a pipette. For an area of 1 dm$^2$ this quantity is 1 ml. To obtain an uniform coating the solution was carefully dispersed over the total surface with a glass rod. After drying of the sample, a layer with a thickness corresponding to about $5.1o^{-4}$g/cm$^2$ light-sensitive substance was obtained.

The material was then exposed for 90 seconds to a collimated beam from a 100 Watt xenon lamp, passed through a transparency at a distance of 6o cm from the sample. Further on, following the technique described in Example 1, a direct positive latent image was obtained which was visualized by chemical metallization. The latter could be copper plating, as described in Example 1, or nickel plating by dipping at 25° to 28°C in a bath with the following composition:

| | |
|---|---|
| $NiCl_2.6H_2O$ | 30 g |
| Sodium citrate | 88 g |
| $NaH_2PO_2$ | 20 g |
| $NH_4Cl$ | 30 g |
| $NH_4OH$(25%) | 25 g |
| $H_2O$ dist. | up to 1 l. |

EXAMPLE 4

On each of the carrier bases, mentioned in the text above, for example polyester barite paper, a layer of light-sensitive substance was applied by evaporation of high-purity silver bromide in a conventional vacuum installation operating at $5.10^{-5}$ torr. The silver bromide was obtained by Malinowsky's method) Journ. Phot. Sci., 8,69, 1960). The evaporation was carried out from a platinium crucible with an aperture (opening) of about 7 mm diameter, at a distance of 8 cm from the substrate. At a temperature of the crucible 740°C, controlled by a Pt/Pt-Rh thermocouple, a layer with a thickness of about 0,45 $\mu$m was deposited for 80 sec onto the carrier base. The thickness was checked with the Film Thickness Monitor.

Immediately after that followed an evaporation in the same installation of a thin layer of tin dichloride. The chloride was evaporated from a quarz crucible with an opening of about 7 mm diameter, at a distance of about 18 cm from the substrate. At a temperature of the crucible of 200°C there was deposited for 15 seconds a layer with a thickness corresponding to about $1.10^{-6}$g/cm$^2$. The rate of deposition was again controlled with tho monitor. Immediately after removal from from the evaporating installation, the photographic material was exposed for 45 to 60 seconds to a 100 Watt incandescent lamp.

After a preliminary activation in a solution of the salt of a noble metal, as described in Example 1, the image was visualized by chemical metallization, as in Example 1, or by physical development by dipping at room temperature in a solution with the following composition:

| Solution A | | Solution B | |
|---|---|---|---|
| Methol | 8,3 g | $AgNO_3$ | 30 g |
| Citric acid | 8,3 g | $H_2O$ dist, | up to 45 ml |
| Glacial acetic acid | 41,7 g | | |
| Gelatine | 6,7 g | | |
| Water dist. | up to 1 l | | |

Before use 50 parts of solution A are mixed with 1 part of solution B.

EXAMPLE 5

One of the aforementioned carrier bases is coated by pouring over with a thin layer of adhesive resin, for example with polyester adhesive 46971, into which preliminary fine powder of a light-sensitive substance, such as cadmium oxide, has been dispersed. The surface of the adhesive was then hydrofilized by dipping for a short time in 30% solution of sodium hydroxide and then the sample was abundantly washed in deionized water.

Further on, a thin layer of tin dichloride was applied by dipping in a solution of the salt as described in Example 1.

Immediately after drying the sample in an air stream, it was exposed for 90 to 120 seconds to a collimated beam from a 100 Watt xenon lamp, passed through a transparency.

After preliminary activation in a solution of a salt of a noble metal, as described in Example 1, the image was visualized by chemical nickel plating as in Example 3, or by physical development by dipping at 18°C in a solution with the following composition:

| | | |
|---|---|---|
| Hydroquinone | | 20 g |
| Citric acid | | 1 g |
| $AgNO_3$ | | 2 g |
| $H_2O$ dist. | up to | 1 l. |

EXAMPLE 6

On one of the aforementioned carrier bases a thin layer of stannous chloride was applied according to the technique described in Example 1.

Then a layer of cadmium iodide was applied by dipping for several seconds in a 5% solution of this salt. After drying of the thin liquid layer remaining onto the sample, a layer of light-sensitive substance was obtained with a thickness corresponding to about $10^{-5}$g/cm² of cadmium iodide.

Further on, following the technique and treatment of Example 3, there was obtained a visible copper or nickes image.

EXAMPLE 7

One of the aforementioned carrier bases, for example polyester film "Melinex S" coated with the adhesive 200 TF (a product of Shipley, USA) was hydrofilized as described in Example 2.

A thin layer of tin dichloride was then applied as described in Example 1, followed by drying of the sample. Immediately after that a layer of lead iodide was applied by evaporation in vacuum. The lead iodide was evaporated at 380°C for 5 minutes from a tantalum crucible. A layer with a thickness corresponding to about $1.10^{-4}$g/cm² was obtained.

The photographic material thus obtained was exposed for 1–2 minutes to a xenon lamp through a transparency, as described in Example 1. The exposed sample was treated in a 40% solution of potassium iodide, which dissolves the layer of lead iodide, and then it is abundantly washed in water.

Then, following the treatment described in Example 1, a copper image was obtained of the transparency. If properly prepared, the image thus obtained can be further thickned by electrolytic copper deposition.

EXAMPLE 8

One of the aforementioned carrier bases, for example polymide film "Capton", was hydrofilized by dipping into a 10% solution of sodium hydroxide for 2–5 minutes at room temperature, and then abundantly washed in deionized water.

Then followed the application of a thin layer of titanium trichloride by dipping for 2 to 3 minutes at room temperature in a 1,5% water solution of the salt. Then the sample was washed in deionized water and dried in an air stream. Immediately after that a layer of cadmium iodide was applied by spraying, as described in Example 2. The photographic material obtained was exposed for 2 minutes to a collimated beam from a 100 Watt xenon lamp, passed through a transparency.

Then, following the treatment described in Example 1, a visible copper image of the transparency was obtained.

EXAMPLE 9

On one of the aforedescribed carrier bases a thin layer of tin dichloride was applied by evaporation in vacuum, as described in Example 4.

Immediately after that and in the same installation a layer of glassy arsenous sulphide was applied by evaporation of the sulphide from a tantalum crucible at about 250°C. For 30 seconds a layer with a thickness corresponding to about $1.10^{-6}$g/cm² of diarsenous trisulphide was obtained.

The photographic material thus obtained was exposed for 1 minute as described in Example 1. The layer of diarsenous trisulphide was then removed by treating the sample for 20 to 30 seconds in a 1% solution of sodium hydroxide, and then the sample was abundantly washed in distilled water.

After a preliminary activation in a solution of a salt of a noble metal, as described in Example 1, the image was visualized by chemical copper plating using the following bath:

| | | |
|---|---|---|
| Solution A: | Copper sulphate (cryst.) | 35 g |
| | Nickel sulphate | 5 g |
| | Distilled water | up to 500 ml |
| Solution B: | Sodium carbonate (cryst.) | 35 g |
| | Seignette salt | 190 g |
| | Sodium hydroxide | 50 g |
| | Distilled water | up to 500 ml |

Before use, solutions A and B were mixed and to the resulting solution were added 10 ml ethyl alcohol and 50 ml 40% formaldehyde.

EXAMPLE 10

On one of the aforementioned carrier bases, for example polyester film "Mylar", a thin layer of stannous sulphide was applied by evaporation in vacuum in an installation as described in Example 1. The sulphide was evaporated from a tantalum crucible of the Knudsen type with a small opening. At a temperature of about 530°C, controlled by Pt/Pt-Rh thermocouples, for 240 seconds there were deposited on the carrier base about $1.10^{-8}$g/cm².

Immediately after the deposition of the tin salt, a layer of cadmium iodide was applied by evaporation, as described in Example 1. After 90 seconds exposure, as described in Example 1, the layer of cadmium iodide was washed in water and then the material was treated as described in Example 1 for obtaining a copper image, or as described in Example 3, for obtaining a nickel image.

EXAMPLE 11

On each of the aforedescribed carrier bases, for example drawing film M5 D50, a thin layer of thallium iodide was applied by evaporation in vacuum. The iodide was evaporated from a tantalum crucible at about 360°C and for 5 minutes a layer of 0,3 $\mu$m thickness was obtained. Immediately after that and in the same installation a thin layer of tin dichloride was applied thereon, as described in Example 4. The photographic material obtained was exposed for 4 minutes to a 100 Watt incandescent lamp.

After activation for a short time in a solution of a salt of a noble metal, the image was developed by conventional physical development as described in Example 4.

EXAMPLE 12

One of the aforementioned carrier bases, for example triacetate film 2002003, was hydrophylized as described in Example 1. Then a thin layer of lead dichloride was applied by dipping for 30 seconds in a heated (to about 45°C) low-salt-acid 3% solution of the salt. The sample was then washed in deionized water for 1 minute at room temperature and dried in an air stream. Immediately after that a layer of cadmium iodide was applied by evaporation in vacuum as described in Example 1. The photographic material obtained was exposed for about 120 seconds to a collimated beam from a 100 Watt xenon lamp, passed through a transparency.

After exposure, the sample was treated as described in Example 1 and as a result a copper image of the transparency was obtained.

What we claim is:

1. A photographic material capable of yielding on imagewise exposure to radiation a direct positive image, which material comprises: a non-metallic carrier base; and on the carrier base, a layer of metal salt selected from the group consisting of halides of divalent tin, divalent lead, trivalent titanium and stannous sulfide and a layer of at least one photo-sensitive compound selected from the group consisting of the halides of silver, cadmium, lead, bismuth, thallium, zinc, copper and mercury and chalcogenides or oxides of arsenic, lead, cadmium, and antimony, said photosensitive compound being capable when activated upon exposure to radiation of reacting chemically with said metal salt layer in a manner such that in any region exposed to radiation the metal salt layer loses its catalytic activity to a metallization baths, and in any region not exposed to radiation the said metal salt layer remains intact, thereby forming a positive latent image which is visualized on intensification by chemical metallization.

2. A photographic material according to claim 1, wherein the thickness of the light-sensitive layer corresponds to $10^{-6}$ up to $10^{-3}$g/cm$^2$, preferably $10^{-4}$g/cm$^2$ light-sensitive substance.

3. A process for the production of a photographic material according to claim 1, capable of yielding on light exposure a direct positive image, which comprises depositing onto a non-metallic carrier base and in intimate contact inbetween of thin layers and light-sensitive substance, which substance upon exposure to light reacts chemically with the metal salt in such a way that in the lighted areas the metal ions of the salt lose their catalytic-active properties, but remain unchanged in the non-lighted areas thereby forming an image capable of being intensified.

4. A process according to claim 3, wherein the thin layer of said metal salt is obtained by evaporation in vacuum or by dipping in a solution of the corresponding metal salt.

5. A process for producing a direct image according to claim 3, wherein, when the layer of light-sensitive substance is applied onto the layer of metal salt, said layer is removed prior to development by dissolving in suitable solvents, whereby the obtained image is stabilized against further light exposure.

6. A process according to claim 3, wherein, after a previous activation of the exposed photographic material by dipping in a solution of a salt of A NOBLE METAL, the positive latent image is intensified and becomes visible by conventional chemical metallization or physical development.

* * * * *